United States Patent [19]

Worsley

[11] Patent Number: 5,046,463

[45] Date of Patent: Sep. 10, 1991

[54] ASSEMBLING DEVICE FOR VALVE ACTUATING COMPONENTS OF INTERNAL-COMBUSTION ENGINES

[75] Inventor: Clifford R. Worsley, Langenfeld, Fed. Rep. of Germany

[73] Assignee: Goetze AG, Burscheid, Fed. Rep. of Germany

[21] Appl. No.: 634,509

[22] Filed: Dec. 27, 1990

[30] Foreign Application Priority Data

Dec. 27, 1989 [DE] Fed. Rep. of Germany ..... 3943115

[51] Int. Cl.[5] ..... F01L 3/10

[52] U.S. Cl. ..... 123/90.67; 29/213.1

[58] Field of Search ..... 123/90.1, 90.67, 188 SC; 29/213.1, 215, 216

[56] References Cited

U.S. PATENT DOCUMENTS

| | | | |
|---|---|---|---|
| 3,490,428 | 1/1970 | Updike et al. | 123/90.37 |
| 3,793,999 | 2/1974 | Seiler et al. | 29/215 |
| 4,919,090 | 4/1990 | Deuring et al. | 123/90.67 |

FOREIGN PATENT DOCUMENTS

| | | |
|---|---|---|
| 179111 | 5/1922 | United Kingdom . |
| 1181388 | 2/1970 | United Kingdom . |

*Primary Examiner*—David A. Okonsky
*Assistant Examiner*—Weilun Lo
*Attorney, Agent, or Firm*—Spencer & Frank

[57] ABSTRACT

An assembling device receiving a valve-actuating subassembly intended for installation about a valve stem in an internal-combustion engine. The subassembly includes a valve spring having opposite first and second ends and a valve spring retainer abutting the valve spring at the first end thereof. The assembling device includes a holder abutting the valve spring retainer; and an axial extension surrounding the holder and being axially displaceable relative thereto. The axial extension includes a stop at a first end of the axial extension for preventing the holder from separating from the axial extension and a hold-back arrangement at a second end of the axial extension for releasably engaging the valve spring at the second end thereof, whereby the stop and the hold-back arrangement together releasably secure the subassembly to the assembling device.

10 Claims, 1 Drawing Sheet

ASSEMBLING DEVICE FOR VALVE ACTUATING COMPONENTS OF INTERNAL-COMBUSTION ENGINES

CROSS REFERENCE TO RELATED APPLICATION

This application claims the priority of Federal Republic of Germany Application No. P 39 43 115.0, filed Dec. 27th, 1989, which is incorporated herein by reference.

BACKGROUND OF THE INVENTION

The present invention relates to an assembling device for aiding in the installation of valve actuating components in internal-combustion engines. The valve actuating components include a valve spring, a valve spring retainer having a recess accommodating a securing element such as a split collar and may also include a spring seat ring. Before assembly, all valve actuating components are held together as a unit by means of a holder disposed at the valve spring retainer. The holder has, along its outer circumference, an axial extension which is releasably connected at an end region with the valve spring or the spring seat ring.

Federal Republic of Germany Offenlegungsschrift 39 07 001, a counterpart to U.S. Pat. No. 4,919,090, discloses a mounting aid with which all valve actuating components can be installed in an engine with only a single tool. That mounting aid includes a holder in the form of a plastic cap which accommodates the valve actuating components and connects all components together to form an installable unit. The holder has an axial extension whose free end is connected with the spring end or the spring seat ring disposed axially opposite the valve spring retainer. The releasable connection in that mounting aid is a snap connection between the spring seat ring and the axial extension. When the mounting aid is used for installing the valve actuating components in the cylinder head of an internal-combustion engine, the mounting aid is pressed over the valve stem until the valve stem extends through the holder. In this position, the mounting aid is moved axially further and the extension is supported at the bottom of the cylinder head and is radially bulged out, thus releasing the snap connection and fixing the valve actuating components in place. Then, the mounting aid is axially removed from the cylinder head.

Although that prior art device provides for a satisfactory installation of the valve actuating components, in some engines the problem is encountered that only a small amount of space is available for installation. For example, in an internal-combustion engine having four valves per cylinder, the radial space available for installation is so small in the region of the valves that the prior art mounting aid is unable to bulge out radially when the device is pressed in; consequently, the snap connection is not able to be released and the valve actuating components cannot be installed.

SUMMARY OF THE INVENTION

It is an object of the present invention to provide an improved assembling device of the above-outlined type so that, even if relatively little space for installation is available, automated installation of all valve actuating components is possible with only a single tool.

This is accomplished by the assembling device of the present invention in that the extension is axially displaceable relative to the holder and the extension is provided, in the region of the valve spring retainer, with a radially inwardly oriented flange or axial stop that holds the valve actuating components together to form an installable unit. In this way, an assembling device is obtained which can be axially pushed together in a telescopic manner and with which all valve actuating elements can be installed on an engine even in particularly narrow spaces.

According to a further feature of the assembling device of the invention, the extension in the region of the valve spring retainer is radially outwardly thickened to terminate in a bead or flange which provides support for the assembling device at the cylinder head during installation. The bead structure permits release of the valve actuating components before the axial extension reaches the plane of the valve spring seat in the cylinder head. During insertion, the assembling device is axially supported on the cylinder head: axial advance of the assembling device into the final installed position causes the axial extension to be automatically released from the end of the valve spring or from the valve spring seat ring, as the case may be. Preferably, the extension is a cylindrical sleeve for receiving the installable unit and, for reasons of cost, is made of plastic.

DESCRIPTION OF THE PREFERRED EMBODIMENT

Figure 1:
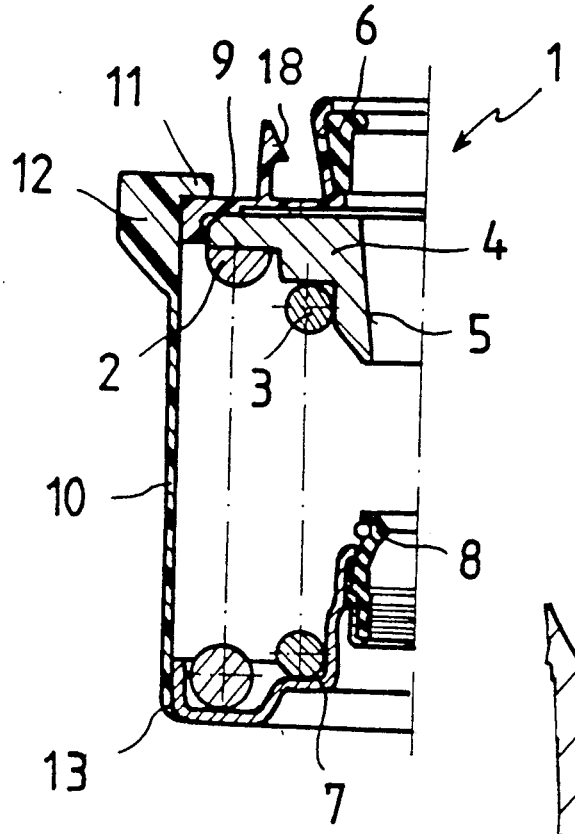
FIG. 1 is an axial sectional view of an assembling device according to a preferred embodiment of the invention, shown before installation of valve actuating components.

FIG. 1 shows an assembling device or mounting aid 1 according to the invention, prior to its being used in the installation process in an internal-combustion engine. The assembling device 1 holds a valve-actuating subassembly which includes two valve springs 2, 3 and a valve spring retainer 4 provided with a conical recess 5 for accommodating segmented fastening members (such as a split collar) 6. The valve actuating components additionally include a spring seat ring 7 which receives a valve stem seal 8.

All of the valve actuating components 2–8 are jointly held together as an installable unit by means of a holder 9 and its axial extension 10, structured according to the invention. The axial extension 10 includes a radially inwardly directed axial stop 11 and is thickened to form a flange or bead 12 in the region of the valve spring retainer 4. The holder 9 and the axial extension 10 are displaceable relative to one another in a telescopic manner and form a cartridge to accommodate all the valve actuating components 2–8. An axial immobilization of the valve actuating components is effected by the stop 11 and a slightly inwardly bent end region or sloped hold-back member 13 of the axial extension 10. The axial extension 10 may be configured as a cylindrical sleeve.

Figure 2:
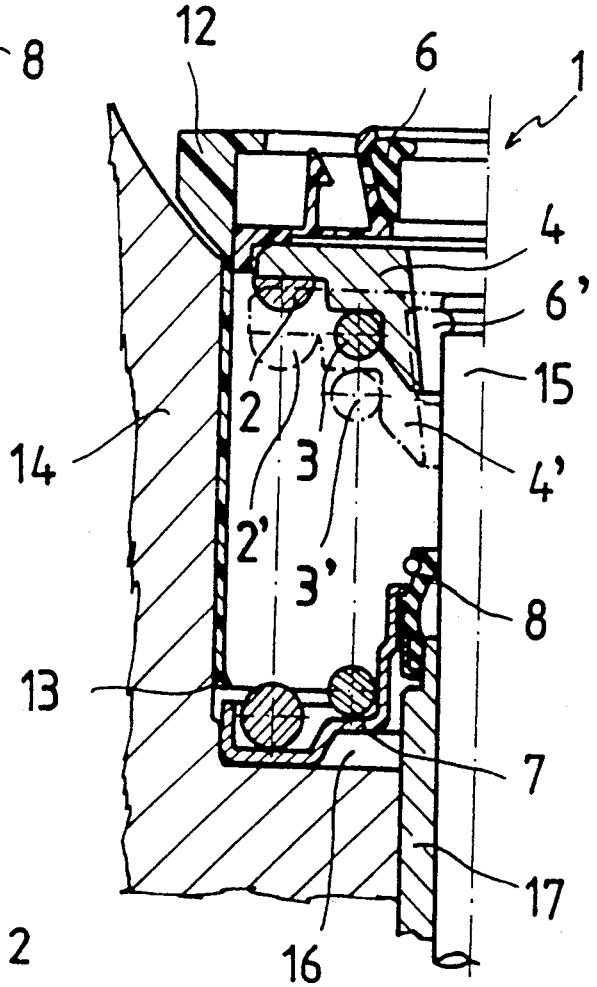
FIG. 2 is a view similar to FIG. 1, showing the assembling device in the process of installing the valve actuating components in an internal-combustion engine.

Turning now to FIG. 2, a cylinder head 14 of an internal-combustion engine and a stem 15 of an associated valve are shown therein. In order to install the valve actuating components 2–8, the assembling device 1 is inserted into a corresponding receiving bore 16 of the cylinder head 14. This axial insertion causes the flange or bead-like thickened portion 12 to abut and to then be axially supported by the cylinder head 14. In this position, a defined spacing exists between the end region 13 and the bottom of the receiving bore 16. By axially further advancing the valve actuating components 2–8, the bent end region or sloped retaining member 13 is automatically released from the spring seat ring 7. This causes the valve actuating components 2–8 to be released by the assembling device 1. Thereafter, a mounting tool (not shown) presses the valve actuating components 2, 3, 4 and 6 into their final installed position (shown in dot-dash lines) 2', 3', 4' and 6' so that the spring seat ring 7 lies against the bottom of the receiving bore 16, the split collar or fastening members 6 provide a connection with the valve 15, and the valve stem seal 8 is positioned on a valve guide 17. The mounting tool can releasably engage a detent member 18 formed on the holder 9 for manipulating the assembling device 1. At the end of the functional steps of the installation process, the assembling device 1 is axially extracted in an opposite direction from the receiving bore 16 and may be reloaded with a new set of valve actuating components 2–8 for further assembling.

It will be understood that the above description of the present invention is susceptible to various modifications, changes and adaptations, and the same are intended to be comprehended within the meaning and range of equivalents of the appended claims.

What is claimed is:

1. An assembling device arranged for receiving a valve-actuating subassembly intended for installation about a valve stem; the subassembly including a valve spring having opposite first and second ends and a valve spring retainer abutting said valve spring at the first end thereof; the assembling device comprising a holder being arranged for abutting the valve spring retainer; and an axial extension surrounding said holder and being axially displaceable relative to said holder; said axial extension having opposite first and second ends; said axial extension including stop means at said first end of said axial extension for preventing said holder from separating from said axial extension; and hold-back means at said second end of said axial extension for releasably engaging the valve spring at the second end thereof, whereby said stop means and said hold-back means are together arranged to releasably secure the subassembly to the assembling device.

2. An assembling device as defined in claim 1, wherein said first end of said axial extension includes a thickened portion forming a radially outwardly oriented flange.

3. An assembling device as defined in claim 2, wherein said flange has a shoulder face adapted to abut, during installation of the valve-actuating subassembly, a surface of a cylinder head of an internal-combustion engine.

4. An assembling device as defined in claim 1, wherein said axial extension comprises a cylindrical sleeve adapted to accommodate the subassembly.

5. An assembling device as defined in claim 1, wherein said axial extension comprises a plastic material.

6. A preassembled structural unit comprising a valve-actuating subassembly intended for installation about a valve stem and including a valve spring having opposite first and second ends and a valve spring retainer abutting said valve spring at the first end thereof;

an assembling device holding said subassembly together and including a holder abutting the valve spring retainer;

an axial extension surrounding said holder and being axially displaceable relative to said holder; said axial extension having opposite first and second ends; said axial extension including stop means at said first end of said axial extension for preventing said holder from separating from said axial extension; and hold-back means at said second end of said axial extension for releasably engaging the valve spring at the second end thereof, whereby said stop means and said hold-back means together releasably secure the subassembly to the assembling device.

7. A preassembled structural unit as defined in claim 6, wherein said first end of said axial extension includes a thickened portion forming a radially outwardly oriented flange.

8. A preassembled structural unit as defined in claim 7, wherein said flange has a shoulder face adapted to abut, during installation of the valve-actuating subassembly, a surface of a cylinder head of an internal-combustion engine.

9. A preassembled structural unit as defined in claim 6, wherein said axial extension comprises a cylindrical sleeve adapted to accommodate the subassembly.

10. A preassembled structural unit as defined in claim 6, wherein said axial extension comprises a plastic material.

* * * * *